US009211696B2

(12) United States Patent
Schwitzky et al.

(10) Patent No.: US 9,211,696 B2
(45) Date of Patent: Dec. 15, 2015

(54) INTAGLIO PRINTING PRESS AND METHOD OF MONITORING OPERATION OF THE SAME

(71) Applicant: KBA-NOTASYS SA, Lausanne (CH)

(72) Inventors: Volkmar Rolf Schwitzky, Würzburg (DE); Volker Scharkus, Würzburg (DE)

(73) Assignee: KBA-NOTASYS SA, Lausanne (CH)

( * ) Notice: Subject to any disclaimer, the term of this patent is extended or adjusted under 35 U.S.C. 154(b) by 0 days.

(21) Appl. No.: 14/433,299

(22) PCT Filed: Oct. 18, 2013

(86) PCT No.: PCT/IB2013/059448

§ 371 (c)(1),
(2) Date: Apr. 2, 2015

(87) PCT Pub. No.: WO2014/060997

PCT Pub. Date: Apr. 24, 2014

(65) Prior Publication Data

US 2015/0258777 A1 Sep. 17, 2015

(30) Foreign Application Priority Data

Oct. 18, 2012 (EP) ..... 12189131

(51) Int. Cl.
*B41F 9/00* (2006.01)
*B41F 33/00* (2006.01)
*B41F 9/02* (2006.01)

(52) U.S. Cl.
CPC ..... *B41F 33/0009* (2013.01); *B41F 9/00* (2013.01); *B41F 9/021* (2013.01); *B41F 33/00* (2013.01)

(58) Field of Classification Search
CPC ..... B41F 33/00; B41F 33/02; B41F 33/0009; B41F 9/021; B41F 9/06; B41F 9/00; B41F 11/02
See application file for complete search history.

(56) References Cited

U.S. PATENT DOCUMENTS 4,516,496 A 5/1985 Giori
5,062,359 A 11/1991 Giori
(Continued)

FOREIGN PATENT DOCUMENTS

CH 477 293 8/1969
EP 0 091 709 10/1983
(Continued)

OTHER PUBLICATIONS
International Search Report for PCT/IB2013/059448 mailed Jan. 24, 2014, 3 pages.
(Continued)

*Primary Examiner* — Blake A Tankersley
(74) *Attorney, Agent, or Firm* — Nixon Vanderhye P.C.

(57) ABSTRACT

There is described an intaglio printing press comprising a plate cylinder (8) carrying one or more intaglio printing plates (8*c*) and an impression cylinder (7) cooperating with the plate cylinder (8), a printing nip being formed between the plate cylinder (8) and the impression cylinder (7). The plate cylinder (8) and the impression cylinder (7) each comprise one or more cylinder pits (8*a*, 7*a*) and a corresponding number of cylinder segments (8*b*, 7*b*), the plate cylinder (8) and the impression cylinder (7) being in rolling contact with one another during printing operations along their respective cylinder segments (8*a*, 7*b*) when no cylinder pits (8*a*, 7*a*) are present at the printing nip. The intaglio printing press further comprises a monitoring system (150) designed to monitor a rolling condition of the impression cylinder (7) with respect to the plate cylinder (8) and to provide an indication as to whether or not the rolling condition corresponds to a desired rolling condition, the desired rolling condition being a rolling condition corresponding to true rolling of the impression cylinder (7) with respect to the plate cylinder (8) where no slippage occurs between a circumferential surface of the impression cylinder (7) and a circumferential surface of the plate cylinder (8). Also described is a method of monitoring operation of an intaglio printing press.

15 Claims, 10 Drawing Sheets

(56) References Cited

U.S. PATENT DOCUMENTS

| | | | | |
|---|---|---|---|---|
| 5,062,360 | A | 11/1991 | Germann et al. | |
| 5,282,417 | A | 2/1994 | Germann | |
| 5,718,171 | A * | 2/1998 | Tittgemeyer et al. | 101/154 |
| 5,740,736 | A | 4/1998 | Toyoda | |
| 5,899,145 | A | 5/1999 | Schaede | |
| 6,111,261 | A | 8/2000 | Bolza-Schünemann et al. | |
| 6,176,482 | B1 | 1/2001 | Reinhard et al. | |
| 6,779,445 | B2 | 8/2004 | Schaede | |
| 7,011,020 | B2 | 3/2006 | Dünninger et al. | |
| 8,231,125 | B2 | 7/2012 | Hendle et al. | |
| 8,516,960 | B2 | 8/2013 | Bollettin et al. | |
| 2002/0117068 | A1 * | 8/2002 | Cote et al. | 101/484 |
| 2003/0010233 | A1 | 1/2003 | Schaede | |
| 2004/0237816 | A1 | 12/2004 | Dunninger et al. | |
| 2005/0127595 | A1 | 6/2005 | Hendle et al. | |
| 2006/0144265 | A1 | 7/2006 | Dünninger et al. | |
| 2007/0181016 | A1 | 8/2007 | Schaede | |
| 2008/0314267 | A1 | 12/2008 | Kumagai et al. | |
| 2009/0096156 | A1 | 4/2009 | Hendle et al. | |
| 2009/0183644 | A1 | 7/2009 | Bollettin et al. | |
| 2009/0288567 | A1 * | 11/2009 | Choi et al. | 101/154 |
| 2012/0312179 | A1 | 12/2012 | Scheade et al. | |
| 2012/0312180 | A1 | 12/2012 | Scheade et al. | |
| 2013/0112095 | A1 | 5/2013 | Schaede et al. | |
| 2014/0218502 | A1 | 8/2014 | Schaede et al. | |

FOREIGN PATENT DOCUMENTS

| | | |
|---|---|---|
| EP | 0 406 157 | 1/1991 |
| EP | 0 415 881 | 3/1991 |
| EP | 0 563 007 | 9/1993 |
| EP | 0 783 964 | 7/1997 |
| EP | 0 873 866 | 10/1998 |
| EP | 1 602 483 | 12/2005 |
| EP | 2 006 095 | 12/2008 |
| IN | 118869 | 8/1969 |
| WO | WO 97/36813 | 10/1997 |
| WO | WO 97/37329 | 10/1997 |
| WO | WO 01/54904 | 8/2001 |
| WO | WO 03/047862 | 6/2003 |
| WO | WO 03/070465 | 8/2003 |
| WO | WO 2004/026580 | 4/2004 |
| WO | WO 2005/118294 | 12/2005 |
| WO | WO 2007/116353 | 10/2007 |
| WO | WO 2011/077348 | 6/2011 |
| WO | WO 2011/077350 | 6/2011 |
| WO | WO 2011/077351 | 6/2011 |
| WO | WO 2011/161656 | 12/2011 |

OTHER PUBLICATIONS

Written Opinion of the International Searching Authority for PCT/IB2013/059448, mailed Jan. 24, 2014, 5 pages.

* cited by examiner

INTAGLIO PRINTING PRESS AND METHOD OF MONITORING OPERATION OF THE SAME

This application is the U.S. national phase of International Application No. PCT/IB2013/059448, filed 18 Oct. 2013, which designated the U.S. and claims priority to EP Patent Application No. 12189131.1 filed 18 Oct. 2012, the entire contents of each of which are hereby incorporated by reference.

TECHNICAL FIELD

The present invention generally relates to intaglio printing, and more particularly to an intaglio printing press and a method of monitoring operation of the same.

BACKGROUND OF THE INVENTION

Intaglio printing presses are widely used in security printing for printing security documents, especially banknotes. Prior art intaglio printing presses are for instance disclosed in Swiss Patent No. CH 477 293 A5, European Patent Publications Nos. EP 0 091 709 A1, EP 0 406 157 A1, EP 0 415 881 A2, EP 0 563 007 A1, EP 0 873 866 A1, EP 1 602 483 A1, and International Publications Nos. WO 01/54904 A1, WO 03/047862 A1, WO 2004/026580 A1, WO 2005/118294 A1, WO 2011/077348 A1, WO 2011/077350 A1, WO 2011/077351 A1, all assigned to the instant Applicant.

FIG. 1 schematically illustrates an intaglio printing press which is generally designated by reference numeral 1. More precisely, FIG. 1 shows a sheet-fed intaglio printing press 1 comprising a sheet feeder 2 for feeding sheets to be printed, an intaglio printing unit 3 for printing the sheets, and a sheet delivery unit 4 for collecting the freshly-printed sheets. The intaglio printing unit 3 includes an impression cylinder 7, a plate cylinder 8 (in this example, the plate cylinder 8 is a three-segment plate cylinder carrying three intaglio printing plates), an inking system comprising an ink-collecting cylinder, or Orlof cylinder, 9 (here a three-segment blanket cylinder carrying a corresponding number of blankets) for inking the surface of the intaglio printing plates carried by the plate cylinder 8 and an ink wiping system 10 for wiping the inked surface of the intaglio printing plates carried by the plate cylinder 8 prior to printing of the sheets.

The sheets are fed from the sheet feeder 2 onto a feeder table and then onto the impression cylinder 7. The sheets are then carried by the impression cylinder 7 to the printing nip between the impression cylinder 7 and the plate cylinder 8 where intaglio printing is performed. Once printed, the sheets are transferred away from the impression cylinder 7 for conveyance by a sheet transporting system 15 in order to be delivered to the delivery unit 4. The sheet transporting system 15 conventionally comprises a sheet conveyor system with a pair of endless chains driving a plurality of spaced-apart gripper bars for holding a leading edge of the sheets (the freshly-printed side of the sheets being oriented downwards on their way to the delivery unit 4), sheets being transferred in succession to a corresponding one of the gripper bars.

During their transport to the sheet delivery unit 4, the freshly printed sheets are preferably inspected by an optical inspection system 5. In the illustrated example, the optical inspection system 5 is advantageously an inspection system as disclosed in International Publication No. WO 2011/161656 A1, which inspection system 5 comprises a transfer mechanism and an inspection drum located at the transfer section between the impression cylinder 7 and chain wheels of the sheet transporting system 15. The optical inspection system 5 could alternatively be an inspection system placed along the path of the sheet transporting system 15 as described in International Publications Nos. WO 97/36813 A1, WO 97/37329 A1, and WO 03/070465 A1. Such inspection systems are in particular marketed by the Applicant under the product designation NotaSave®.

Before delivery, the printed sheets are preferably transported in front of a drying or curing unit 6 disposed after the inspection system 5 along the transport path of the sheet transporting system 15. Drying or curing could possibly be performed prior to the optical inspection of the sheets.

FIG. 2 is a schematic view of the intaglio printing unit 3 of the intaglio printing press 1 of FIG. 1. As already mentioned, the printing unit 3 basically includes the impression cylinder 7, the plate cylinder 8 with its intaglio printing plates, the inking system with its ink-collecting cylinder 9, and the ink wiping system 10.

The inking system comprises in this example five inking devices 20, all of which cooperate with the ink-collecting cylinder 9 that contacts the plate cylinder 8. It will be understood that the illustrated inking system is adapted for indirect inking of the plate cylinder 8, i.e. inking of the intaglio printing plates via the ink-collecting cylinder 9. The inking devices 20 each include an ink duct 21 cooperating in this example with a pair of ink-application rollers 22. Each pair of ink-application rollers 22 in turn inks a corresponding chablon cylinder 23 which is in contact with the ink-collecting cylinder 9. As is usual in the art, the surface of the chablon cylinders 23 is structured so as to exhibit raised portions corresponding to the areas of the intaglio printing plates intended to receive the inks in the corresponding colours supplied by the respective inking devices 20.

As shown in FIGS. 1 and 2, the impression cylinder 7 and plate cylinder 8 are both supported by a stationary (main) frame 50 of the printing press 1. The inking devices 20 (including the ink duct 21 and ink-application rollers 22) are supported in a mobile inking carriage 52, while the ink-collecting cylinder 9 and chablon cylinders 23 are supported in an intermediate carriage 51 located between the inking carriage 52 and the stationary frame 50. Both the inking carriage 52 and the intermediate carriage 51 are advantageously suspended under supporting rails. In FIG. 1, reference numeral 52' designates the inking carriage in a retracted position shown in dashed lines.

The twin-carriage configuration of the intaglio printing press 1 illustrated in FIGS. 1 and 2 corresponds in essence to the configuration disclosed in International Publications Nos. WO 03/047862 A1, WO 2011/077348 A1, WO 2011/077350 A1 and WO 2011/077351 A1, all assigned to the present Applicant and which are incorporated herein by reference in their entirety.

The ink wiping system 10, on the other hand, typically comprises a wiping tank, a wiping roller assembly 11 supported on and partly located in the wiping tank and contacting the plate cylinder 8, cleaning means (not shown) for removing wiped ink residues from the surface of the wiping roller assembly 11 using a wiping solution that is sprayed or otherwise applied onto the surface of the wiping roller assembly 11, and a drying blade (not shown) contacting the surface of the wiping roller assembly 11 for removing wiping solution residues from the surface of the wiping roller assembly 11. A particularly suitable solution for the ink wiping system 10 is disclosed in International Publication No. WO 2007/116353 A1.

A particularity of intaglio printing presses as used for the production of security documents resides in the fact that very high printing pressures are applied at the printing nip between the plate cylinder and the impression cylinder, with line pressures in the range of 10'000 N/cm or more, i.e. more than 80 tons over the entire contact portion between the plate cylinder and the impression cylinder. These very high printing pressures lead to the characteristic embossing and tactile effect that is readily recognizable on intaglio-printed security documents, like banknotes.

A plate cylinder of an intaglio printing press, as for instance shown in FIGS. 1 and 2, typically consists of a cylinder base made of e.g. steel that carries one or more intaglio printing plates which are typically nickel plates (or any other suitable metal such as steel, brass or the like) whose surface is typically covered by a layer of wear-resistant material such as chromium (Cr). On the other hand, an impression cylinder of an intaglio printing press, as for instance shown in FIGS. 1 and 2, typically consists of a cylinder base made of e.g. steel which carries one or more impression blankets and one or more underlay sheets (or packing sheets) of e.g. paper or cardboard, the thickness of which is calibrated.

At the printing nip between the plate cylinder and the impression cylinder, the surface of the impression cylinder is typically compressed by the comparatively harder and more rigid surface of the plate cylinder, which leads to a local compression and deformation of the impression blanket and underlying packing sheets. The amount of compression and deformation depends on the pressure applied at the printing nip, but also on the nature and compressibility of the impression blanket and underlying packing sheets, as well as the relevant thickness of the intaglio printing plate(s) on the plate cylinder side and thickness of the impression blanket(s) and packing sheets on the impression cylinder side. It is to be further appreciated that the sheet material, which is held onto the circumference of the impression cylinder, is pressed at the printing nip between the plate cylinder and the impression cylinder.

As is typical in the art, the plate cylinder and the impression cylinder of intaglio printing presses each commonly comprise one or more cylinder pits and a corresponding number of cylinder segments, the plate cylinder and the impression cylinder coming into rolling contact with one another along their respective cylinder segments when no cylinder pits are present at the printing nip. In the example of FIGS. 1 and 2, both the plate cylinder and the impression cylinder comprise three cylinder pits 8*a*, resp. 7*a*, and three cylinder segments 8*b*, resp. 7*b* each. Three intaglio printing plates, designated by reference 8*c*, are mounted on the circumference of the plate cylinder 8, namely on the three cylinder segments 8*b*, while three sets of impression blankets and packing sheets, jointly designated by reference 7*c*, are mounted on the circumference of the impression cylinder 7, namely on the three cylinder segments 7*b*. The plate cylinder and impression cylinder may however exhibit different numbers of cylinder pits and cylinder segments (as for instance disclosed in European Patent Publication No. EP 0 873 866 A1). In any event, upon coming into rolling contact of the plate cylinder and the impression cylinder, when the trailing end of the cylinder pits leaves the printing nip, the surface of the impression cylinder starts to be compressed as a result of the pressure applied at the printing nip between the plate cylinder and impression cylinder, which compression is applied for as long as the plate cylinder and impression cylinder are in rolling contact with one another along their respective cylinder segments. This leads to considerable mechanical constraints and stresses on the components (in particular the bearing and driving components) of the intaglio printing unit, which mechanical constraints and stresses are applied throughout the duration of the contact between the cylinders. These mechanical constraints and stresses are suppressed upon interruption of the rolling contact between the plate cylinder and the impression cylinder, namely when the leading end of the cylinders pits enters the printing nip.

For all of the above reasons, intaglio printing units have to be very robust and be designed in such a way as to withstand the aforementioned huge forces and stresses that are generated during printing operations.

This being said, multiple parameters may have an impact on the operation of the intaglio printing unit of intaglio printing presses and the resulting print quality, which parameters are dependent on operative settings made by the operator of the intaglio printing press. Such operative settings in particular include the amount of pressure applied at the printing nip during printing operations (which printing pressure is typically adjustable), the type and thickness of the intaglio printing plates, the type and thickness of the impression blankets, and the type, number and thickness of the underlying packing sheets.

In that context, European Patent Publication No. EP 0 783 964 A1 merely discloses an intaglio printing press comprising means for adjusting the contact pressure between the impression cylinder and intaglio cylinder of the intaglio printing press. Similarly, European Patent Publication No. EP 2 006 095 A2 merely discloses an intaglio printing press wherein the nip pressure (contact pressure) between various cylinders and/or rollers of the intaglio printing press can be adjusted automatically.

Depending on the relevant operative settings made by the operator, operation of the intaglio printing press may potentially exceed desired and optimum operating conditions, which could lead to excessive wear and/or inadequate printing quality.

Furthermore, the operating conditions change over time, especially as a result of the alteration of the structure and properties of the impression blankets and underlying packing sheets, as well as, to a certain extent, as a result of the deformation and elongation of the intaglio printing plates.

There is therefore a need for an intaglio printing press and a method of monitoring operation of the same which can ensure that optimum and desired operating conditions of the intaglio printing press can be guaranteed and maintained over time.

SUMMARY OF THE INVENTION

A general aim of the invention is therefore to provide an improved intaglio printing press and an improved method of monitoring operation of an intaglio printing press.

A further aim of the invention is to provide an intaglio printing press and a method of monitoring operation of the same which ensures optimum operation of the intaglio printing press within desired operating conditions, thereby reducing wear and improving the life-cycle expectancy of the intaglio printing press, as well as ensuring optimum printing conditions.

Another aim of the invention is to provide such a solution that allows an operator to identify whether or not the intaglio printing press is being operated within desired operating conditions.

These aims are achieved thanks to the intaglio printing press and method of monitoring the operation of an intaglio printing press defined in the claims.

There is accordingly provided an intaglio printing press comprising a plate cylinder carrying one or more intaglio printing plates and an impression cylinder cooperating with the plate cylinder, a printing nip being formed between the plate cylinder and the impression cylinder, the plate cylinder and the impression cylinder each comprising one or more cylinder pits and a corresponding number of cylinder segments, the plate cylinder and the impression cylinder being in rolling contact with one another during printing operations along their respective cylinder segments when no cylinder pits are present at the printing nip, wherein the intaglio printing press comprises a monitoring system designed to monitor a rolling condition of the impression cylinder with respect to the plate cylinder and to provide an indication as to whether or not the rolling condition corresponds to a desired rolling condition, the desired rolling condition being a rolling condition corresponding to true rolling of the impression cylinder with respect to the plate cylinder where no slippage occurs between a circumferential surface of the impression cylinder and a circumferential surface of the plate cylinder.

Preferably, the monitoring system provides continuous or periodic measurements of a difference between a rotational position of the impression cylinder and a rotational position of the plate cylinder as the plate cylinder and the impression cylinder are in rolling contact with one another along their respective cylinder segments, and wherein an evolution of the difference between the rotational position of the impression cylinder and the rotational position of the plate cylinder as the plate cylinder and the impression cylinder are in rolling contact with one another along their respective cylinder segments is indicative of the rolling condition.

In this context, the monitoring system may advantageously include a first rotary encoder providing a measurement of the rotational position of the plate cylinder, a second rotary encoder providing a measurement of the rotational position of the impression cylinder, and a processing unit computing the difference between the rotational position of the impression cylinder and the rotational position of the plate cylinder.

There is also provided a method of monitoring operation of an intaglio printing press comprising a plate cylinder carrying one or more intaglio printing plates and an impression cylinder cooperating with the plate cylinder, a printing nip being formed between the plate cylinder and the impression cylinder, the plate cylinder and the impression cylinder each comprising one or more cylinder pits and a corresponding number of cylinder segments, the plate cylinder and the impression cylinder being in rolling contact with one another during printing operations along their respective cylinder segments when no cylinder pits are present at the printing nip, the method comprising the steps of monitoring a rolling condition of the impression cylinder with respect to the plate cylinder and providing an indication as to whether or not the rolling condition corresponds to a desired rolling condition, the desired rolling condition being a rolling condition corresponding to true rolling of the impression cylinder with respect to the plate cylinder where no slippage occurs between a circumferential surface of the impression cylinder and a circumferential surface of the plate cylinder.

Preferably, the monitoring step includes providing continuous or periodic measurements of a difference between a rotational position of the impression cylinder and a rotational position of the plate cylinder as the plate cylinder and the impression cylinder are in rolling contact with one another along their respective cylinder segments, an evolution of the difference between the rotational position of the impression cylinder and the rotational position of the plate cylinder as the plate cylinder and the impression cylinder are in rolling contact with one another along their respective cylinder segments being indicative of the rolling condition.

In this context, a substantially linear evolution of the difference between the rotational position of the impression cylinder and the rotational position of the plate cylinder as the plate cylinder and the impression cylinder are in rolling contact with one another along their respective cylinder segments is indicative of a desired rolling condition, whereas a substantially non-linear evolution of the difference between the rotational position of the impression cylinder and the rotational position of the plate cylinder as the plate cylinder and the impression cylinder are in rolling contact with one another along their respective cylinder segments is indicative of an undesired rolling condition.

In accordance with an advantageous embodiment of the invention, the intaglio printing press further comprises a main drive driving the plate cylinder and the impression cylinder into rotation via gears comprising a first gear coupled to the plate cylinder for rotation with the plate cylinder and a second gear meshing with the first gear and being coupled to the impression cylinder for rotation with the impression cylinder, and the desired rolling condition corresponds to a condition where the second gear is allowed to move with respect to the first gear while the plate cylinder and the impression cylinder are in rolling contact with one another along their respective cylinder segments by an amount which does not exceed a gear backlash of the first and second gears.

Preferably, the first gear is driven into rotation by the main drive and acts as driving gear, and the desired rolling condition corresponds to a condition where:

(i) the second gear is in contact with a leading face of the first gear upon coming into rolling contact of the plate cylinder and the impression cylinder one with the other, when a trailing end of the cylinder pits leaves the printing nip;

(ii) the second gear is allowed to move away from the leading face of the first gear while the plate cylinder and the impression cylinder are in rolling contact with one another along their respective cylinder segments; and (iii) the second gear does not come into contact with a trailing face of the first gear before the rolling contact between the plate cylinder and the impression cylinder is interrupted, when a leading end of the cylinder pits enters the printing nip.

Advantageously, a warning may be generated in case the rolling condition is indicative of an undesired rolling condition.

Further advantageous embodiments of the invention form the subject-matter of the dependent claims and are discussed below.

BRIEF DESCRIPTION OF THE DRAWINGS

Other features and advantages of the present invention will appear more clearly from reading the following detailed description of embodiments of the invention which are presented solely by way of non-restrictive examples and illustrated by the attached drawings in which.

DETAILED DESCRIPTION OF EMBODIMENTS OF THE INVENTION

The present invention will be described in the particular context of the application to a sheet-fed intaglio printing press as used for the production of banknotes and like security documents, where the intaglio printing press comprises a three-segment plate cylinder and a three-segment impression cylinder cooperating with the plate cylinder, namely cylinders each comprising three cylinder segments separated by a corresponding number of, namely three, cylinder pits. It shall however be appreciated that the invention is applicable to intaglio printing presses comprising a plate cylinder and an impression cylinder with any number of cylinder pits and segments. The number of cylinder pits and cylinder segments could be as low as one and does not need to be the same for both cylinders, i.e. the plate cylinder and impression cylinders could have different diameters (even though this is not preferred). From a practical perspective, the number of cylinder pits and cylinder segments is however preferably limited to three or four as the entire intaglio printing unit otherwise gets too big.

Figure 1:
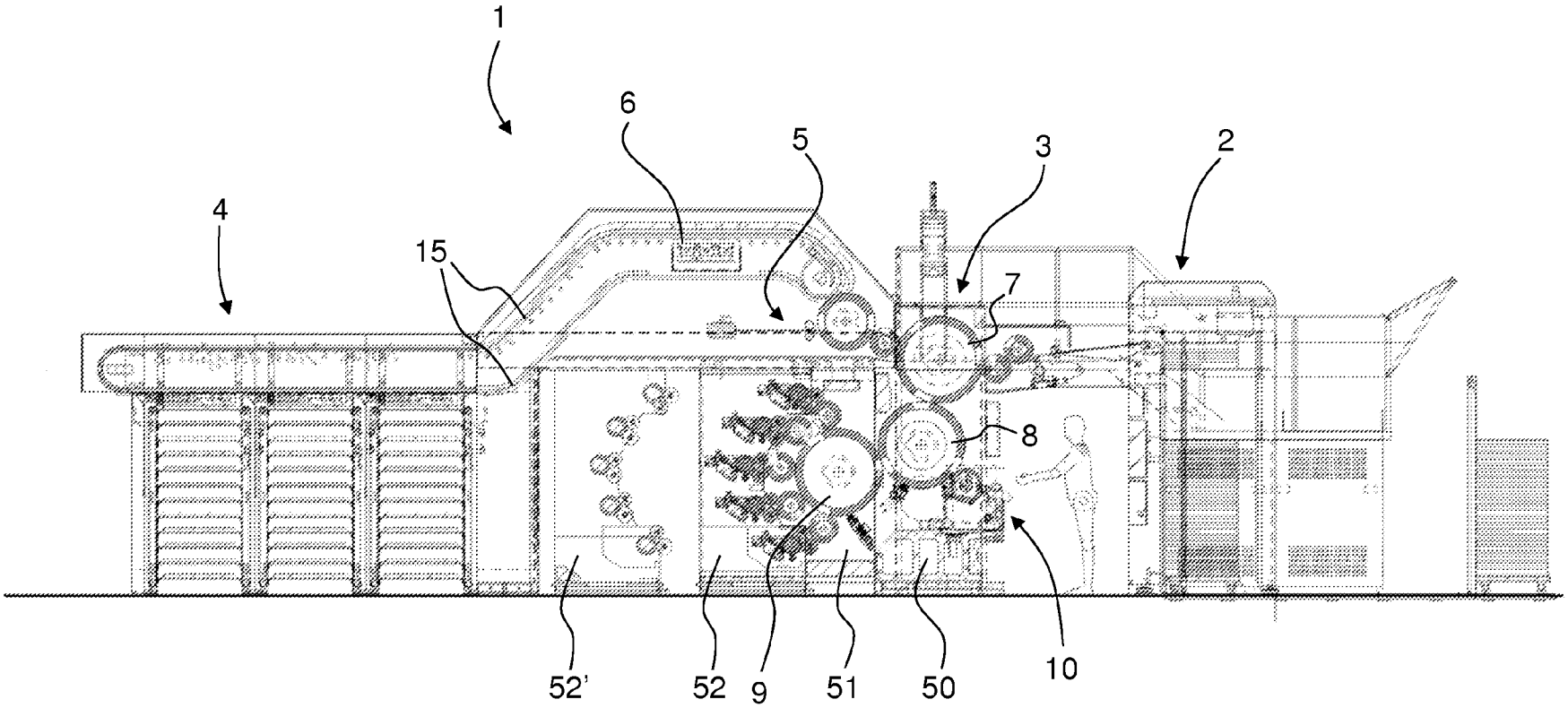
FIG. 1 is a side-view of an intaglio printing press according to a first example.
Figure 2:
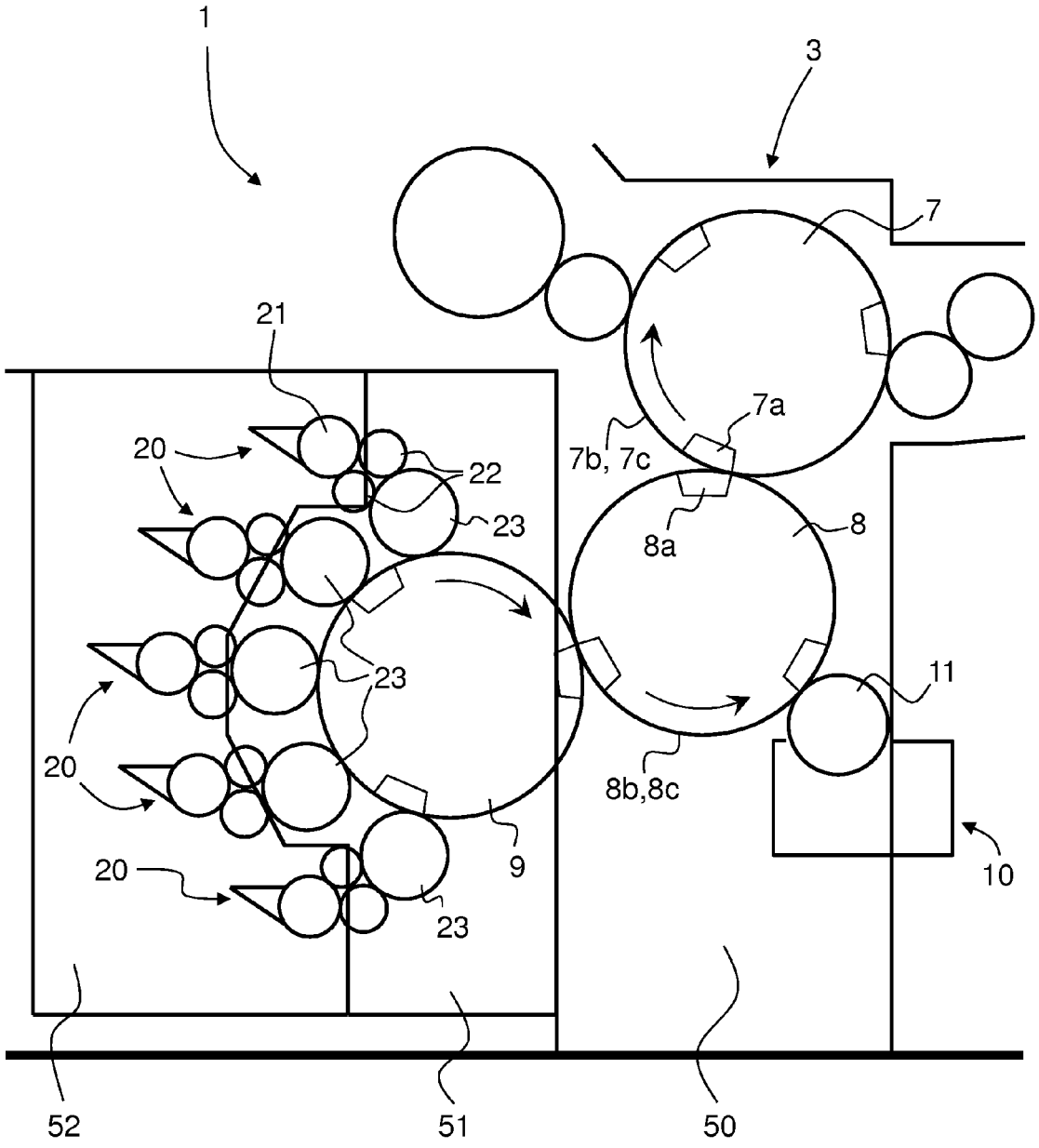
FIG. 2 is an enlarged schematic side view of the printing unit of the intaglio printing press of FIG. 1.
Figure 3:
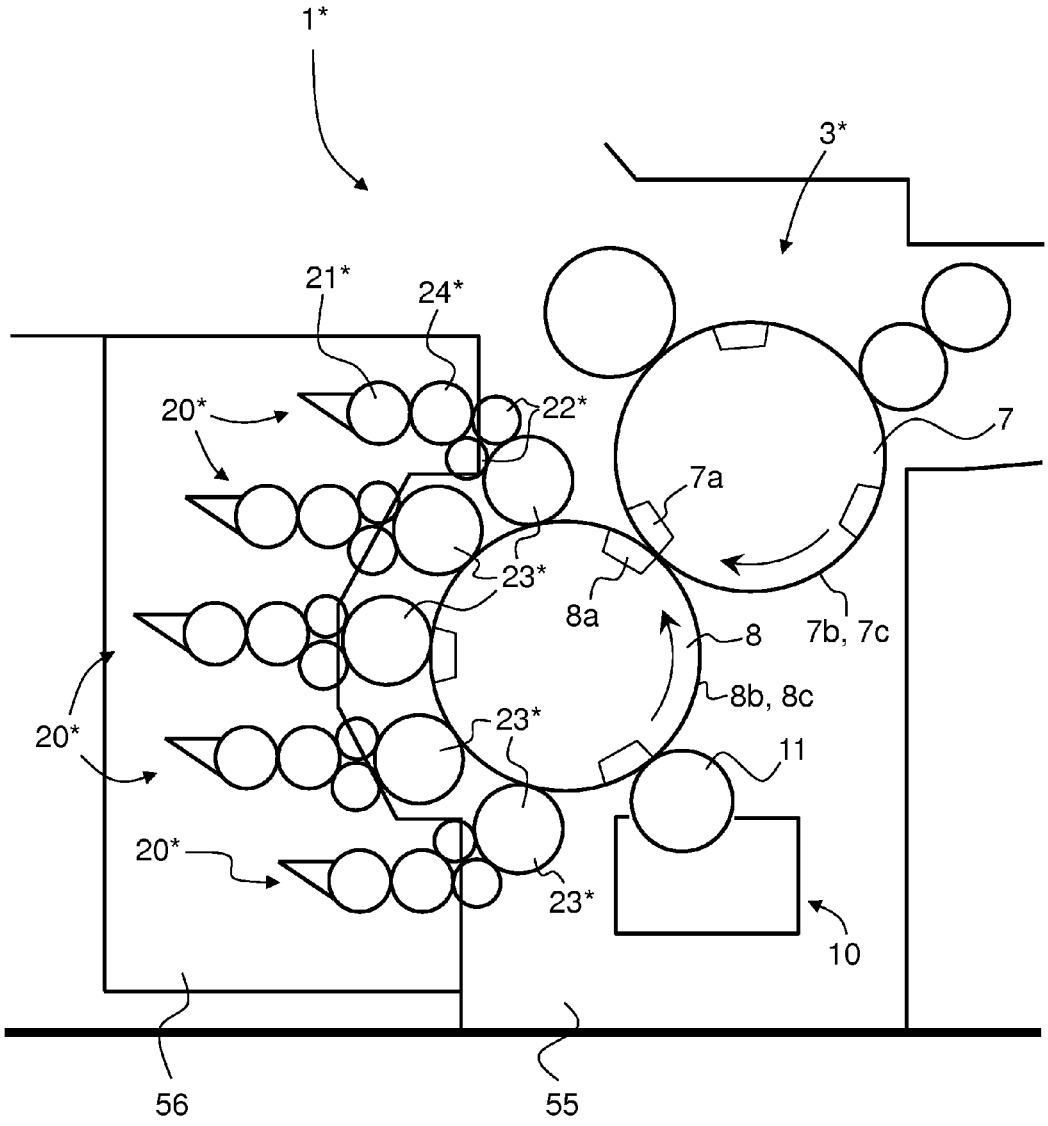
FIG. 3 is a schematic partial side view of an intaglio printing press according to a second example.

In the following description, the expression "chablon cylinder" (which is equivalent to the expression "colour-selector cylinder" also used in the art) is to be understood as designating a cylinder with raised portions whose purpose is to selectively transfer ink patterns to the circumference of the plate cylinder, whether indirectly (as shown in FIGS. 1 and 2) or directly (as shown in FIG. 3). Furthermore, the expression "ink-collecting cylinder" (which is in particular relevant to the example shown in FIGS. 1 and 2) designates within the context of the present invention a cylinder whose purpose is to collect inks from multiple chablon cylinders (which have been inked by associated inking devices) before transferring the resulting multicolor pattern of inks onto the plate cylinder. In the art of intaglio printing, the expression "Orlof cylinder" is also typically used as an equivalent to the expression "ink-collecting cylinder".

FIGS. 1 and 2 have already been discussed in the preamble hereof and basically show a sheet-fed intaglio printing press 1 with a so-called indirect inking system comprising an ink-collecting cylinder, or Orlof cylinder, 9 (here a three-segment blanket cylinder carrying a corresponding numbering of blankets).

FIG. 3 is a schematic partial side view of an intaglio printing press according to a second example, which intaglio printing press is designated by reference numeral 1*, for the sake of distinction. In contrast to the example shown in FIGS. 1 and 2, the intaglio printing press 1* of FIG. 3 comprises a printing unit 3* with a direct inking system (i.e. without any ink-collecting cylinder), the chablon cylinders, designated by reference numerals 23*, cooperating directly with the plate cylinder 8.

In the example of FIG. 3, the inking devices, designated by reference numerals 20*, each include, in this example, an ink duct 21*, an ink-transfer roller 24*, and a pair of ink-application rollers 22* adapted to cooperate with the associated chablon cylinder 23*. The inking devices 20* are supported on an inking carriage 56 that is adapted to move between a working position (shown in FIG. 3) and a retracted position (not shown) in a way similar to the inking carriage 52 of FIGS. 1 and 2. The impression cylinder 7, plate cylinder 8, chablon cylinders 23* and ink wiping system 10 are all supported in a stationary frame 55 of the intaglio printing press 1*.

The present invention is in particular applicable, but not only, in the context of the intaglio printing press 1 of FIGS. 1 and 2 or the intaglio printing press 1* of FIG. 3, these non-limiting examples being only given for the purpose of illustration. The invention is actually applicable to any intaglio printing press equipped with an impression cylinder cooperating with a plate cylinder, including web-fed intaglio printing presses as for instance disclosed in International Publication No. WO 2004/026580 A1.

Figure 4A:
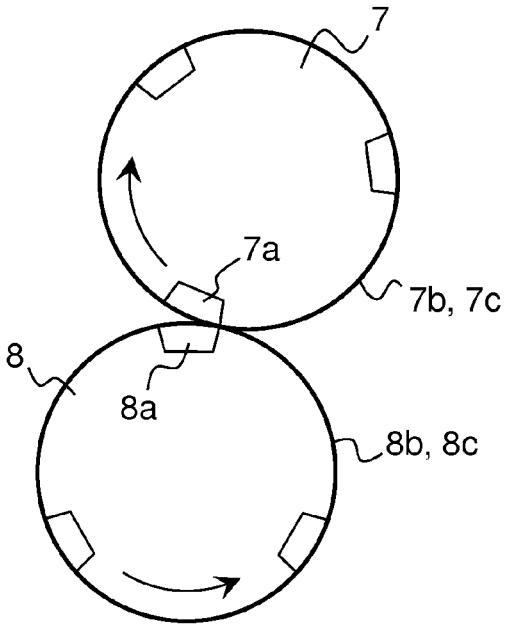
FIG. 4A is a schematic illustration of the plate cylinder and impression cylinder of the intaglio printing press of FIGS. 1 and 2 in a state where the cylinders are coming into rolling contact with one another, i.e. when a trailing end of the cylinder pits leaves the printing nip.
Figure 4B:
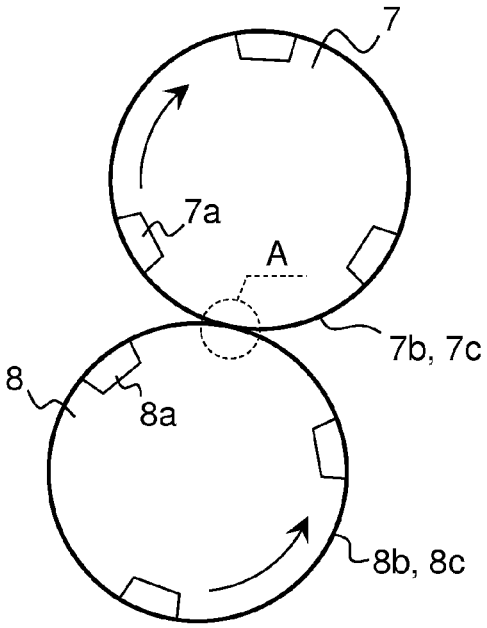
FIG. 4B is a schematic illustration of the plate cylinder and impression cylinder of the intaglio printing press of FIGS. 1 and 2 in a state where the cylinders are in rolling contact with one another along their respective cylinder segments, i.e. when no cylinder pits are present at the printing nip.
Figure 4C:
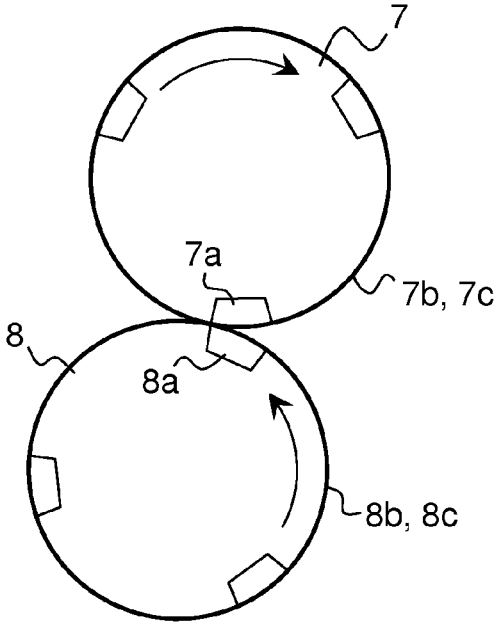
FIG. 4C is a schematic illustration of the plate cylinder and impression cylinder of the intaglio printing press of FIGS. 1 and 2 in a state where the rolling contact between the cylinders is interrupted, i.e. when a leading end of the cylinder pits enters the printing nip.

FIGS. 4A to 4C are schematic illustrations of the impression cylinder 7 and plate cylinder 8 of FIGS. 1 and 2, in different rotational positions, with their respective cylinder pits 7*a*, 8*a*, and cylinder segments 7*b*, 8*b*. As already mentioned, an impression blanket and one or more underlying packing sheets (jointly designated by reference 7*c*) are mounted on each cylinder segment 7*b* of the impression cylinder 7, while an intaglio printing plate (designated by reference 8*c*) is mounted on each cylinder segment 8*b* of the plate cylinder 8.

More precisely, FIG. 4A illustrates the cylinders 7, 8 in a state where they are coming into rolling contact with one another, i.e. when a trailing end of the cylinder pits 7*a*, 8*a* leaves the printing nip. FIG. 4B, on the other hand, shows the cylinders 7, 8 in a state where they are in rolling contact with one another along their respective cylinder segments 7*b*, 8*b*. Lastly, FIG. 4C shows the cylinders 7, 8 in a state where the rolling contact between the cylinders is interrupted, i.e. when a leading end of the cylinder pits 7*a*, 8*a* enters the printing nip.

Figure 5:
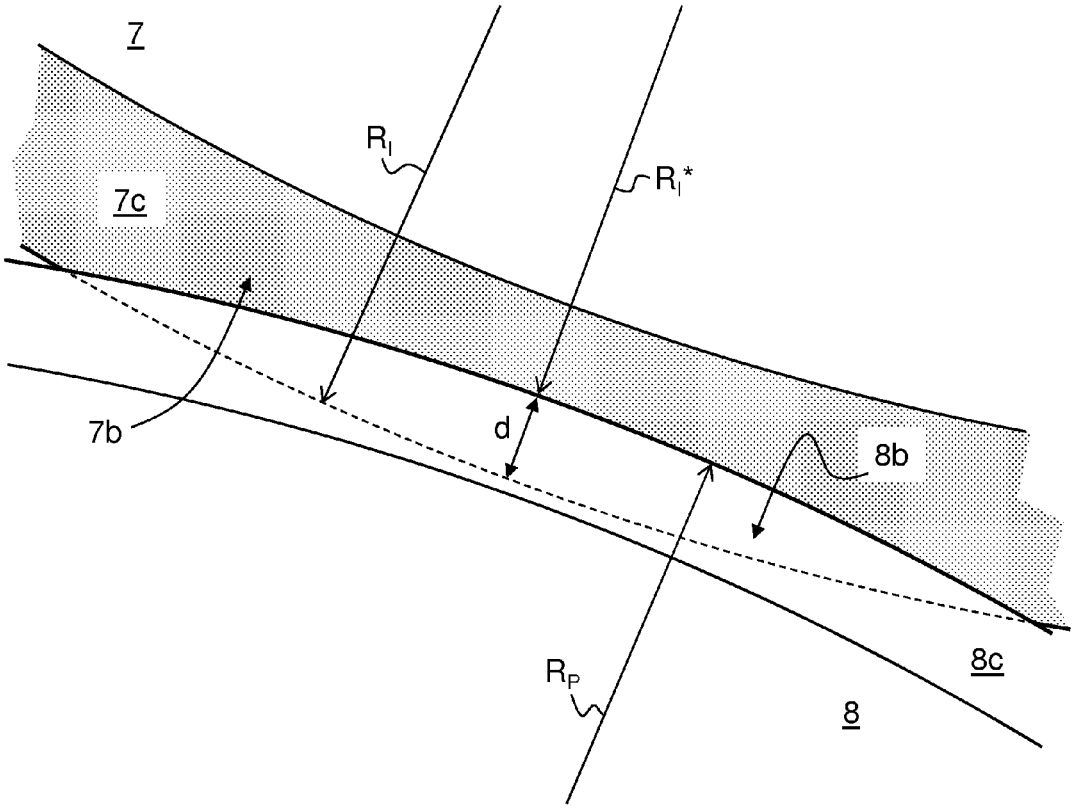
FIG. 5 is an enlarged schematic view of location A indicated in FIG. 4B illustrating the local deformation of the impression blanket and packing sheets under the pressure applied at the printing nip.

FIG. 5 is an enlarged view of the printing nip location (identified by reference A in FIG. 4B) schematically illustrating the local deformation of the impression blanket and packing sheets 7*c* (and of the sheet, not illustrated in FIG. 5) as a result of the pressure applied at the printing nip when the plate cylinder 8 and impression cylinder 7 are in rolling contact with one another. The drawing of FIG. 5 is not drawn to scale, but schematically illustrates that the impression blanket (and underlying packing sheets) 7*c* are compressed at the printing nip. For the purpose of the discussion, it can be assumed that the plate cylinder 8 and intaglio printing plate 8*c* are substantially rigid, whereas the impression blanket (and underlying packing sheets) 7*c* on the impression cylinder 7 are at least partly compressible. In that respect, it can be assumed that the effective radius of the plate cylinder 8 at the printing nip corresponds to the radius of the plate cylinder 8 (including the printing plate 8*c*), which radius is designated by reference $R_P$ in FIG. 5. In contrast, the effective radius of the impression cylinder 7 at the printing nip, designated by reference $R_I$* in FIG. 5, is smaller than the radius (without deformation) $R_I$ of the impression cylinder 7 (including the impression blanket and underlying packing sheets 7*c*) by an amount corresponding to the deformation d of the impression blanket (and packing sheets) 7*c*, i.e. $R_I^*=R_I-d$. In practice, the effective radius $R_P$ of the plate cylinder 8 and the effective radius $R_I$* of the impression cylinder 7 are not the same.

Figure 6:
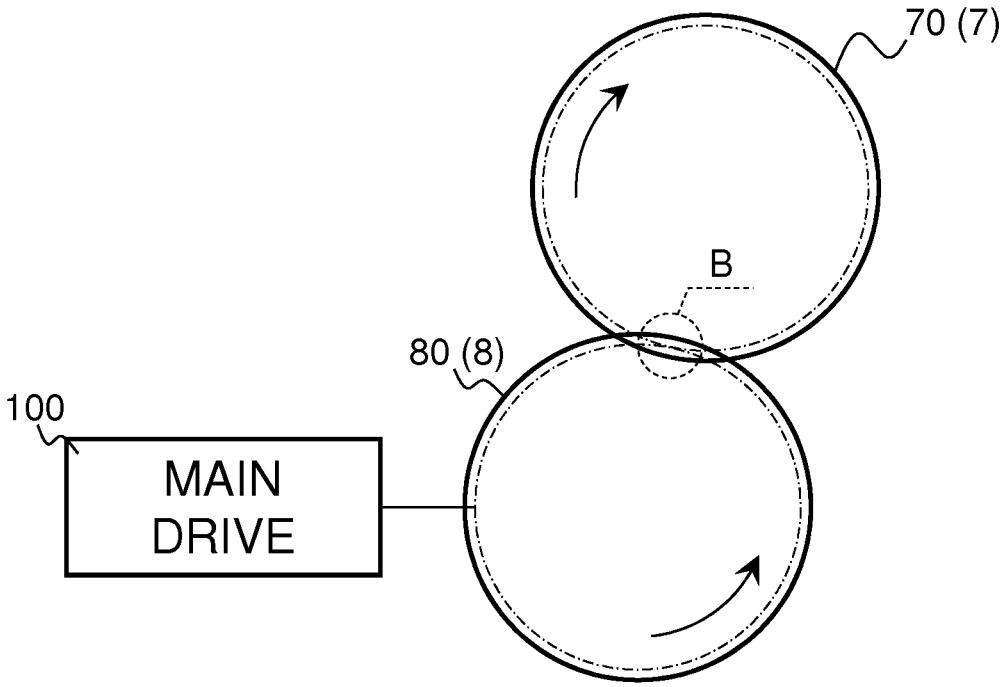
FIG. 6 is a schematic illustration of a driving arrangement used to drive the plate cylinder and impression cylinder into rotation, which driving arrangement includes a first gear, or driving gear, that is coupled to the plate cylinder and a second gear that is coupled to the impression cylinder.

Driving into rotation of the plate cylinder 8 and impression cylinder 7 is typically carried out by means of a main drive driving the plate cylinder 8 and impression cylinder 7 into rotation via gears. FIG. 6 is a schematic illustration of a typical driving arrangement for cylinders 7, 8 comprising a main drive 100 which drives the plate cylinder 8 and the impression cylinder 7 into rotation via gears, the gears comprising a first gear 80 coupled to the plate cylinder 8 for rotation therewith and a second gear 70 meshing with the first gear 80 and being coupled to the impression cylinder 7 for rotation therewith. Gears 70, 80 are typically helical gears. In the schematic illustration of FIG. 6, the main drive 100 drives the first gear 80 into rotation (whether directly or indirectly), which first gear 80 acts as driving gear. The second gear 70 is driven by the first gear 80 at an average rotational speed that depends on the relevant gear ratio. In the illustrated example, the gears 70, 80 have the same size (and same number of teeth), meaning that the relevant gear ratio is 1:1.

Figure 7A:
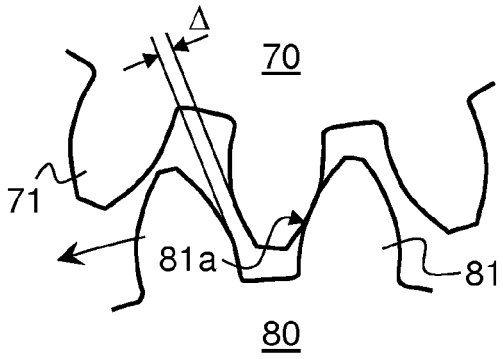
FIG. 7A is an enlarged schematic view of location B indicated in FIG. 6 showing the first and second gears in a state where they are in driving contact with one another along a leading face of the first gear.
Figure 7B:
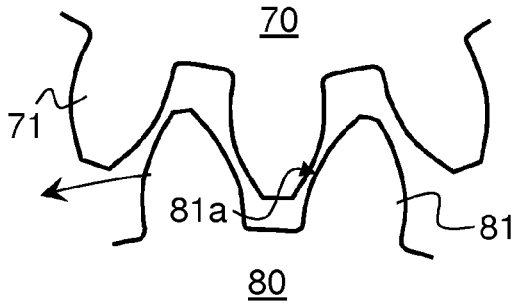
FIG. 7B is an enlarged schematic view of location B indicated in FIG. 6 showing the first and second gears in a state where the second gear is moving away from the leading face of the first gear.
Figure 7C:
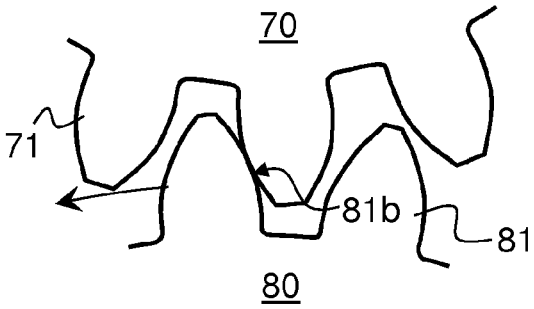
FIG. 7C is an enlarged schematic view of location B indicated in FIG. 6 showing the first and second gears in a state where the second gear is coming into contact with a trailing face of the first gear.

FIGS. 7A to 7C are three enlarged schematic views of location B indicated in FIG. 6, i.e. the location where the teeth 81 of the first gear 80 engage with the teeth 71 of the second gear 70. FIG. 7A shows the first and second gears in a state where they are in driving contact with one another along a leading face 81*a* of the first gear 80. As shown in FIG. 7A, the gears 70, 80 typically engage, with a certain gear play (or "gear backlash") Δ being present between the teeth 71, 81 of the gears 70, 80. In this state, the second gear 70 is in effect driven into rotation by the first gear 80. For the sake of the discussion, it can be assumed that FIG. 7A illustrates the state of the first and second gears upon coming into rolling contact of the plate cylinder 8 and impression cylinder 7 one with the other as shown in FIG. 4A, i.e. when a trailing end of the cylinder pits 7*a*, 8*a* leaves the printing nip. Starting from this point, a high pressure is applied at the printing nip between the plate cylinder 8 and the impression cylinder 7, which leads to the deformation of the impression blanket (and underlying packing sheets) 7*c* as discussed in reference to FIG. 5 and affects the rolling condition between the plate cylinder 8 and impression cylinder 7 as this will be explained hereinafter.

Let us assume for the sake of illustration that the effective radius $R_I$* of the impression cylinder 7 at the printing nip is smaller than the effective radius $R_P$ of the plate cylinder 8 and that the impression blanket and underlying packing sheets 7*c* behave essentially as a compressible medium, the impression cylinder 7 will in effect be led to rotate, as a result of the friction with the plate cylinder 8, at a higher rotational speed compared to that of the plate cylinder 8. As a consequence, the second gear 70 will move away from the leading face 81*a* of the first gear 80 as shown in FIG. 7B. The second gear 70 cannot however move indefinitely with respect to the first gear 80, but movement is restricted by the relevant gear backlash Δ. In other words, the second gear 70 may eventually come into contact with a trailing face 81*b* of the first gear 80 as shown in FIG. 7C. Beyond this point, the second gear 70 will in effect be blocked by the first gear 80 and the impression cylinder 7 forced to rotate at a rotational speed that is lower than that dictated by the friction between the two cylinders 7, 8. This will in effect lead to a slip (or slippage) between the circumferential surfaces of the plate cylinder 8 and impression cylinder 7, namely between the surface of the intaglio printing plate 8*c* and the surface of the impression blanket 7*c*, which is not desirable.

In another extreme case, assuming that the effective radius $R_I$* of the impression cylinder 7 at the printing nip is too important, for instance because the impression blanket and underlying packing sheets 7*c* are inadequately thick, the second gear 70 may be led to work against the rotation imposed by the first gear 80, which will likewise lead to a slip between the circumferential surfaces of the plate cylinder 8 and impression cylinder 7, which is not desirable either.

Optimal rolling conditions can however be defined between the above two extreme situations, namely by ensuring that a rolling condition of the impression cylinder 7 with respect to the plate cylinder 8 substantially corresponds to a true rolling of the impression cylinder 7 with respect to the plate cylinder 8, i.e. a condition where no slippage occurs between a circumferential surface of the impression cylinder 7 and a circumferential surface of the plate cylinder 8. In the context of the above-mentioned example, true rolling can in particular be achieved by ensuring that the second gear 70 is allowed to move with respect to the first gear 80, while the plate cylinder 8 and the impression cylinder 7 are in rolling contact with one another along their respective cylinder segments 8*b*, 7*b*, by an amount which does not exceed the gear backlash Δ of the first and second gears 80, 70.

More precisely, in the context of the aforementioned example, the desired rolling condition equating to true rolling corresponds to a condition where:

(i) the second gear 70 is in contact with a leading face 81*a* of the first gear 80 (as shown in FIG. 7A) upon coming into rolling contact of the plate cylinder 8 and the impression cylinder 7 one with the other, when a trailing end of the cylinder pits 8*a*, 7*a* leaves the printing nip (FIG. 4A);

(ii) the second gear 70 is allowed to move away from the leading face 81*a* of the first gear 80 (as shown in FIG. 7B) while the plate cylinder 8 and the impression cylinder 7 are in rolling contact with one another along their respective cylinder segments 8*b*, 7*b* (FIG. 4B); and (iii) the second gear 70 does not come into contact with a trailing face 81*b* of the first gear 80 (i.e. one avoids the situation shown in FIG. 7C) before the rolling contact between the plate cylinder 8 and the impression cylinder 7 is interrupted, when a leading end of the cylinder pits 8*a*, 7*a* enters the printing nip (FIG. 4C).

In accordance with the invention, the intaglio printing press is accordingly provided with a suitable monitoring system designed to monitor the rolling condition of the impression cylinder 7 with respect to the plate cylinder 8 and to provide an indication as to whether or not the rolling condition corresponds to a desired rolling condition.

Figure 8:
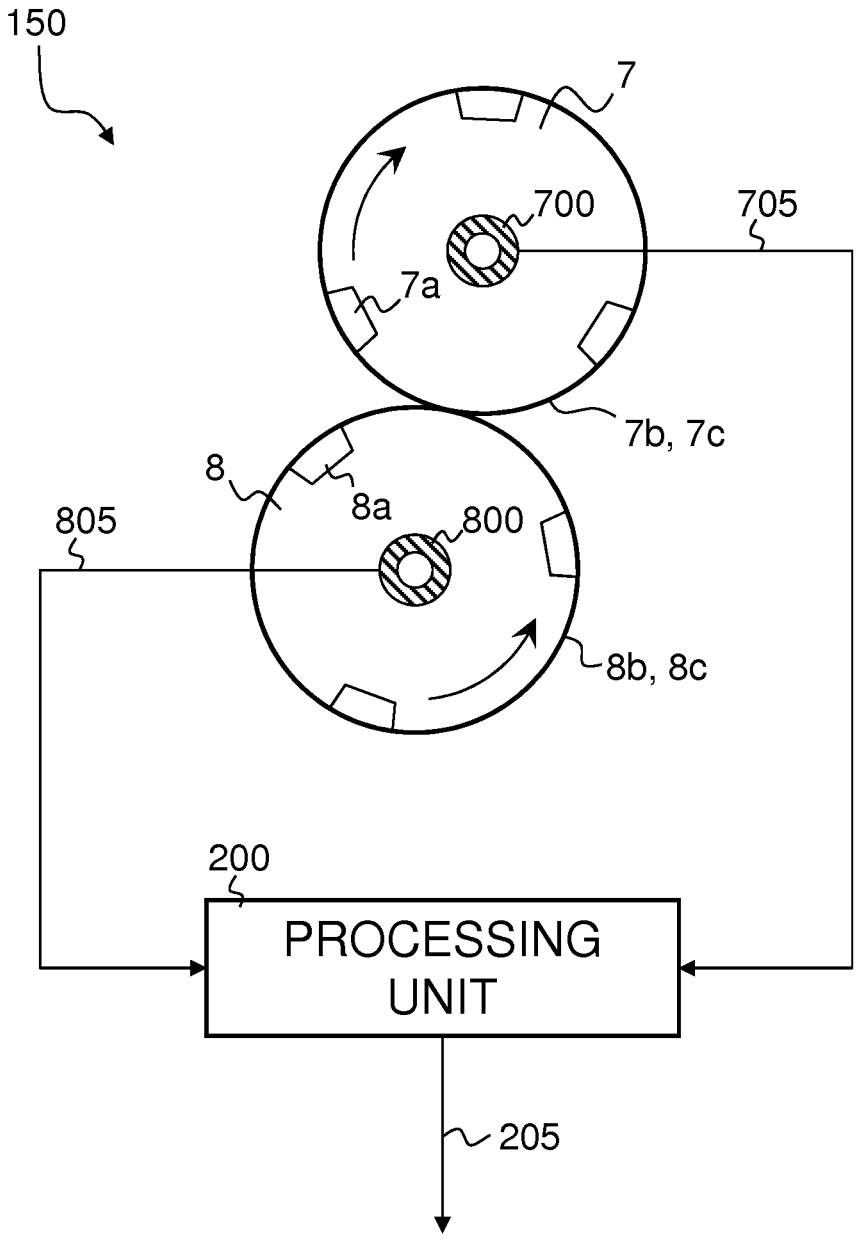
FIG. 8 is a schematic illustration of a rolling condition monitoring system in accordance with an embodiment of the invention.

FIG. 8 illustrates a preferred and non-limiting embodiment of a suitable monitoring system generally designated by reference numeral 150. This monitoring system 150 is advantageously designed to provide continuous or periodic measurements of a difference between a rotational position of the impression cylinder 7 and a rotational position of the plate cylinder 8 as the plate cylinder 8 and the impression cylinder 7 are in rolling contact with one another along their respective cylinder segments 8*b*, 7*b*. As shown in FIG. 8, the monitoring system 150 preferably includes a first rotary encoder 800 measuring the rotational position of the plate cylinder 8 and a second rotary encoder 700 measuring the rotational position of the impression cylinder 7. Each rotary encoder 700, 800 provides a suitable measurement 705, resp. 805 of the rotational position of the associated cylinder 7, resp. 8. The rotary encoders 700, 800 can either be absolute rotary encoders providing an absolute measurement of the rotational position or incremental rotary encoders providing a relative measurement of the rotational position, namely an incremental change in rotational position.

Alternatives to the use of rotary encoders are however possible, including the use of speed sensors measuring the respective rotational speeds of the impression cylinder and plate cylinder.

As further shown in FIG. 8, signals 705, 805 from the rotary encoders 700, 800 are supplied to a processing unit 200 which processes the signals 705, 805 and computes the difference between the rotational position of the impression cylinder 7 and the rotational position of the plate cylinder 8. The computed difference can be outputted directly by the processing unit 200 as a signal 205, for instance for display on monitor so that the operator of the press can visualize the rolling condition of the impression cylinder 7 with respect to the plate cylinder 8 (for instance in the form of a chart as shown in FIGS. 9 and 10).

Alternatively (or in addition to the outputting of the computed difference), the processing unit 200 may further process the computed difference in order to identify whether or not the rolling condition corresponds to a desired rolling condition. Such further processing can be based on the following considerations discussed in reference to FIGS. 9 and 10 hereof.

Figure 9:
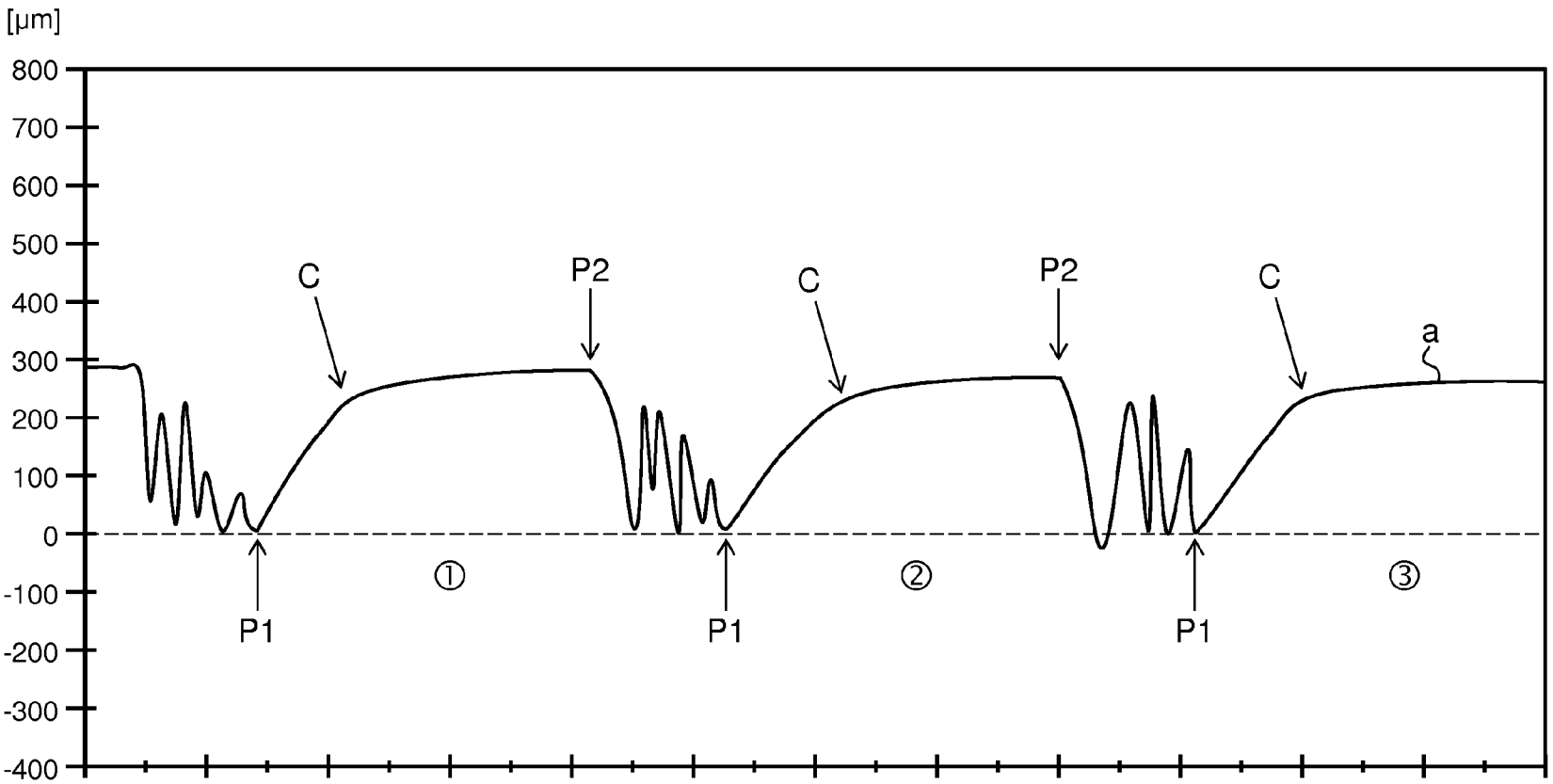
FIG. 9 is a schematic illustration of an exemplary curve representing an undesired rolling condition.
Figure 10:
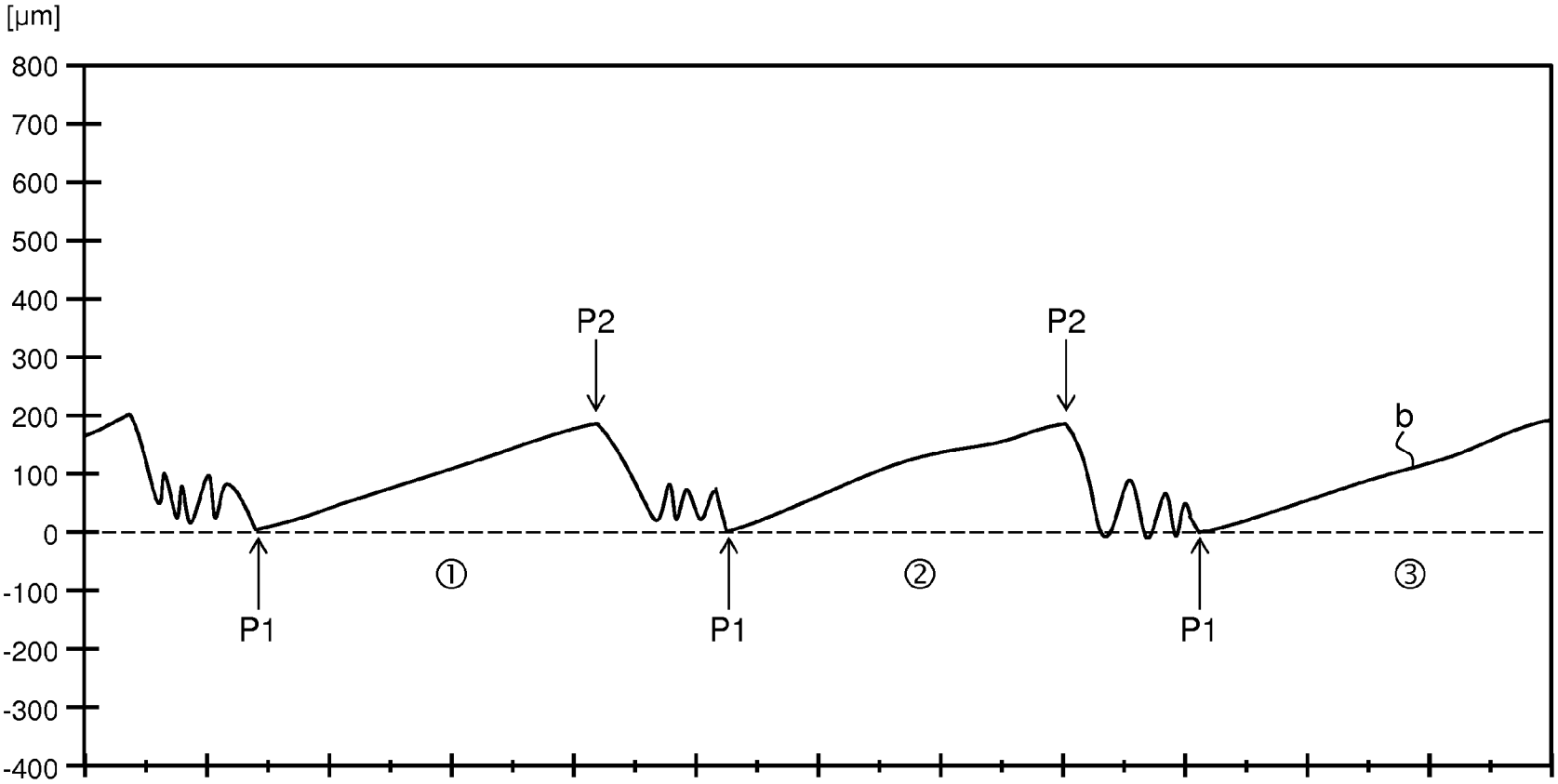
FIG. 10 is a schematic illustration of an exemplary curve representing a desired, true rolling condition.

FIGS. 9 and 10 are schematic illustrations of exemplary curves "a" and "b" respectively representing an undesired and a desired rolling condition. The charts of FIGS. 9 and 10 actually show an example of a possible evolution over time (measured along the horizontal axis in FIGS. 9, 10) of the difference between the rotational position of the impression cylinder 7 and the plate cylinder 8 (which difference is indicated along the vertical axis in FIGS. 9, 10). The charts of FIGS. 9 and 10 show the relevant evolution of the difference in rotational position over a number of successive cylinder segments, points P1 being indicative of the moment coinciding with the coming into rolling contact of the plate cylinder 8 and impression cylinder 7 (as illustrated by FIG. 4A), while P2 is indicative of the moment coinciding with the end of the rolling contact between the plate cylinder 8 and impression cylinder 7 (as illustrated by FIG. 4C). The evolution of the curve between points P1 and P2 (i.e. the segment of curve P1-P2) is representative of the relevant rolling condition for each relevant cylinder segment pair 7*b*-8*b*. In the aforementioned example where the impression cylinder 7 and plate cylinder 8 are both three-segment cylinders, the chart will therefore show the relevant rolling conditions for each of the three cylinder segment pairs 7*b*-8*b* in succession (references ①, ②, ③ in FIGS. 9 and 10 designating the relevant cylinder segment pairs 7*b*-8*b*).

Looking at the illustration of FIG. 9, one can note that the segments of curve P1-P2 are in each case non-linear and in particular exhibit a point C beyond which the segment of curve apparently reaches a maximum. This point C coincides with the coming into contact of the second gear 70 with the trailing face 81*b* of the first gear 80 (as shown in FIG. 7C), which situation is undesirable. Beyond this point C, the rolling condition of the impression cylinder 7 with respect to the plate cylinder 8 does not correspond to a true rolling condition.

In contrast, looking at the illustration of FIG. 10, one can note that the segments of curve P1-P2 are in each case substantially linear, which is indicative of the fact that the impression cylinder 7 is following the rotational movement dictated by the friction with the plate cylinder 8, i.e. the rolling condition corresponds essentially to a true rolling condition.

In other words, it is possible to differentiate between a desired rolling condition or an undesired rolling condition by checking if the evolution of the difference in rotational position of cylinders 7 and 8 between points P1 and P2 is substantially linear (as shown in FIG. 10) or substantially non-linear (as shown in FIG. 9).

In case of an undesired rolling condition, a warning can be generated to draw the operator's attention. In case an undesired rolling condition is identified, the operator may then take appropriate corrective actions, in particular adjust the pressure between the plate cylinder 8 and the impression cylinder 7, change an impression blanket and/or a packing sheet 7*c* on the impression cylinder 7, and/or change an intaglio printing plate 8*c* on the plate cylinder 8.

It should be appreciated that the rolling condition may differ from one cylinder segment pair 7*b*-8*b* to another, in which case corrective actions may only need to be taken in relation the relevant cylinder segment pair 7*b*-8*b* for which an undesired rolling condition is detected.

Advantageously, a geometry of a leading end of the cylinder pits 8*a* of the plate cylinder 8 (where the trailing end of the intaglio printing plate 8*c* is located and secured) is selected to match that of a leading end of the cylinder pits 7*a* of the impression cylinder 7 (where the trailing end of the impression blanket is located and secured). In this way, one additionally ensures a smooth and symmetric release of the printing pressure upon interruption of the rolling contact between the cylinder segments 7*b*, 8*b*. Different geometries at the leading end of the cylinder pits 7*a*, 8*a* may lead to the generation of undesired residual forces upon interruption of the rolling contact between the cylinder segments 7*b*, 8*b*.

Various modifications and/or improvements may be made to the above-described embodiments without departing from the scope of the invention as defined by the annexed claims. For instance, while FIG. 8 shows a monitoring system making use of rotary encoders to provide measurements of the rotational positions of the impression cylinder and plate cylinder, one may alternatively contemplate to use speed sensors measuring the respective rotational speeds of the impression cylinder and plate cylinder and compute the difference of the rotational speeds rather than the difference of the rotational positions between the impression cylinder and plate cylinder. In that respect, a constant speed difference would constitute an indication of the desired rolling condition. In contrast, slippage between the circumferential surfaces of the plate cylinder and impression cylinder will be identified as a change in the difference of the rotational speeds of the impression cylinder and plate cylinder.

It should also be appreciated that other driving arrangements than that illustrated in FIG. 6 could be contemplated to drive the plate cylinder and impression cylinder in rotation.

For instance, the main drive could alternatively drive the second gear that is coupled to the impression cylinder, in which case the second gear would act as the driving gear.

In addition, the invention is applicable to any intaglio printing press comprising a plate cylinder carrying one or more intaglio printing plates and an impression cylinder cooperating with the plate cylinder as defined in the claims.

LIST OF REFERENCE NUMERALS USED THEREIN

1 (sheet-fed) intaglio printing press (first example)
1* (sheet-fed) intaglio printing press (second example)
2 sheet feeder
3 intaglio printing unit (first example)
3* intaglio printing unit (second example)
4 sheet delivery (with three delivery pile units)
5 optical inspection system (e.g. NotaSave®)
6 drying or curing unit
7 impression cylinder (three-segment cylinder)
7*a* cylinder pit(s) on impression cylinder 7
7*b* cylinder segment(s) of impression cylinder 7
7*c* set of impression blanket and underlying packing sheets mounted on circumference of impression cylinder 7
$R_I$ theoretical radius of impression cylinder 7 (including impression blanket and packing sheets 7*c*)
$R_I$* effective radius of impression cylinder 7 at the printing nip (with compressed impression blanket and packing sheets 7*c*)
d deformation of impression blanket and underlying packing sheets 7*c* at printing nip
8 plate cylinder (three-segment plate cylinder carrying three intaglio printing plates)
8*a* cylinder pit(s) on plate cylinder 8
8*b* cylinder segment(s) of plate cylinder 8
8*c* intaglio printing plate mounted on circumference of plate cylinder 8
$R_P$ theoretical radius of plate cylinder 8 (including intaglio printing plate 8*c*)
9 ink collecting cylinder/Orlof cylinder (three-segment blanket cylinder—first example)
10 ink wiping system
11 rotating wiping roller assembly of ink wiping system 10 (contacts circumference of plate cylinder 8)
15 sheet transporting system (sheet conveyor system with a pair of endless chains driving a plurality of spaced-apart gripper bars for holding a leading edge of the sheets)
20 (five) inking devices (first example)
21 ink duct (first example)
22 ink-application rollers (first example)
23 (five) chablon cylinders/selective inking cylinders transferring ink onto ink-collecting cylinder 9 (first example)
20* (five) inking devices (second example)
21* ink duct (second example)
22* ink-application rollers (second example)
23* (five) chablon cylinders/selective inking cylinders transferring ink onto plate cylinder 8 (second example)
24* ink transfer rollers (second example)
50 stationary machine frame supporting impression cylinder 7, plate cylinder 8 and ink wiping system 10 (first embodiment)
51 intermediate carriage supporting ink-collecting cylinder 9 and chablon cylinders 23 (first embodiment)
52 inking carriage supporting inking devices 20 (first example)
52' inking carriage 52 in the retracted position (first example)
55 stationary machine frame supporting impression cylinder 7, plate cylinder 8, chablon cylinders 23* and ink wiping system 10 (second example)
56 inking carriage supporting inking devices 20* (second example)
70 gear coupled to impression cylinder 7 for rotation therewith
71 teeth of gear 70
80 gear coupled to plate cylinder 8 for rotation therewith (driving gear)
81 teeth of gear 80
81*a* leading face (driving face) of (teeth 81 of) first gear 80
81*b* trailing face of (teeth 81 of) first gear 80
Δ gear backlash (or gear play) between gears 70 and 80
100 main drive of intaglio printing press
150 rolling condition monitoring system
200 processing unit
205 signal produced by processing unit 200 indicative of rolling condition of impression cylinder 7 with respect to plate cylinder 8
700 rotary encoder (measurement of rotational position of impression cylinder 7)
705 signal of rotary encoder 700 (e.g. rotational position of impression cylinder 7)
800 rotary encoder (measurement of rotational position of plate cylinder 8)
805 signal of rotary encoder 800 (e.g. rotational position of plate cylinder 8)
a curve schematically representing the difference between the rotational position of the impression cylinder 7 as measured by rotary encoder 700 and the rotational position of the plate cylinder 8 as measured by rotary encoder 800 (undesired rolling condition)
b curve schematically representing the difference between the rotational position of the impression cylinder 7 as measured by rotary encoder 700 and the rotational position of the plate cylinder 8 as measured by rotary encoder 800 (true rolling condition)
P1 point on curve a or b coinciding with the coming into rolling contact of plate cylinder 8 and impression cylinder 7
P2 point on curve a or b coinciding with the end of the rolling contact between plate cylinder 8 and impression cylinder 7
C point on curve a beyond which the rolling condition does not correspond to a true rolling condition
P1-P2 evolution of curve a or b between points P1 and P2 indicative of the rolling condition (undesired rolling condition or true rolling condition) of impression cylinder 7 with respect to plate cylinder 8

The invention claimed is:

1. An intaglio printing press comprising a plate cylinder carrying one or more intaglio printing plates and an impression cylinder cooperating with the plate cylinder, a printing nip being formed between the plate cylinder and the impression cylinder, the plate cylinder and the impression cylinder each comprising one or more cylinder pits and a corresponding number of cylinder segments, the plate cylinder and the impression cylinder being in rolling contact with one another during printing operations along their respective cylinder segments when no cylinder pits are present at the printing nip, wherein the intaglio printing press comprises a monitoring system designed to monitor a rolling condition of the impression cylinder with respect to the plate cylinder and to provide an indication as to whether or not the rolling condition corresponds to a desired rolling condition, the desired rolling condition being a rolling condition corresponding to true rolling of the impression cylinder with respect to the plate cylinder where no slippage occurs between a circumferential surface of the impression cylinder and a circumferential surface of the plate cylinder.

2. The intaglio printing press as defined in claim 1, wherein the monitoring system is designed to provide continuous or periodic measurements of a difference between a rotational position of the impression cylinder and a rotational position of the plate cylinder as the plate cylinder and the impression cylinder are in rolling contact with one another along their respective cylinder segments, wherein an evolution of the difference between the rotational position of the impression cylinder and the rotational position of the plate cylinder as the plate cylinder and the impression cylinder are in rolling contact with one another along their respective cylinder segments is indicative of the rolling condition, and wherein the monitoring system is designed to provide an indication of the said evolution which is indicative of the rolling condition.

3. The intaglio printing press as defined in claim 2, wherein the monitoring system includes a first rotary encoder providing a measurement of the rotational position of the plate cylinder, a second rotary encoder providing a measurement of the rotational position of the impression cylinder, and a processing unit computing the difference between the rotational position of the impression cylinder and the rotational position of the plate cylinder.

4. The intaglio printing press as defined in claim 1, wherein a geometry of a leading end of the one or more cylinder pits of the plate cylinder matches that of a leading end of the one or more cylinder pits of the impression cylinder.

5. The intaglio printing press as defined in claim 1, further comprising a main drive driving the plate cylinder and the impression cylinder into rotation via gears comprising a first gear coupled to the plate cylinder for rotation with the plate cylinder and a second gear meshing with the first gear and being coupled to the impression cylinder for rotation with the impression cylinder, wherein the desired rolling condition corresponds to a condition where the second gear is allowed to move with respect to the first gear while the plate cylinder and the impression cylinder are in rolling contact with one another along their respective cylinder segments by an amount which does not exceed a gear backlash of the first and second gears.

6. The intaglio printing press as defined in claim 5, wherein the first gear is driven into rotation by the main drive and acts as driving gear, and wherein the desired rolling condition corresponds to a condition where:

(i) the second gear is in contact with a leading face of the first gear upon coming into rolling contact of the plate cylinder and the impression cylinder one with the other, when a trailing end of the cylinder pits leaves the printing nip;

(ii) the second gear is allowed to move away from the leading face of the first gear while the plate cylinder and the impression cylinder are in rolling contact with one another along their respective cylinder segments; and (iii) the second gear does not come into contact with a trailing face of the first gear before the rolling contact between the plate cylinder and the impression cylinder is interrupted, when a leading end of the cylinder pits enters the printing nip.

7. The intaglio printing press as defined in claim 1, wherein the monitoring system monitors the rolling condition of the impression cylinder with respect to the plate cylinder for each cylinder segment of the impression cylinder coming into rolling contact with a relevant one of the cylinder segments of the plate cylinder.

8. The intaglio printing press as defined in claim 1, wherein the monitoring system is further designed to output a warning in case the rolling condition is indicative of an undesired rolling condition.

9. The intaglio printing press as defined in claim 1, wherein the plate cylinder and the impression cylinder exhibit the same number of cylinder pits and cylinder segments.

10. A method of monitoring operation of an intaglio printing press comprising a plate cylinder carrying one or more intaglio printing plates and an impression cylinder cooperating with the plate cylinder, a printing nip being formed between the plate cylinder and the impression cylinder, the plate cylinder and the impression cylinder each comprising one or more cylinder pits and a corresponding number of cylinder segments, the plate cylinder and the impression cylinder being in rolling contact with one another during printing operations along their respective cylinder segments when no cylinder pits are present at the printing nip, the method comprising the steps of monitoring a rolling condition of the impression cylinder with respect to the plate cylinder and providing an indication as to whether or not the rolling condition corresponds to a desired rolling condition, the desired rolling condition being a rolling condition corresponding to true rolling of the impression cylinder with respect to the plate cylinder where no slippage occurs between a circumferential surface of the impression cylinder and a circumferential surface of the plate cylinder.

11. The method as defined in claim 10, wherein the monitoring step includes providing continuous or periodic measurements of a difference between a rotational position of the impression cylinder and a rotational position of the plate cylinder as the plate cylinder and the impression cylinder are in rolling contact with one another along their respective cylinder segments, and wherein an evolution of the difference between the rotational position of the impression cylinder and the rotational position of the plate cylinder as the plate cylinder and the impression cylinder are in rolling contact with one another along their respective cylinder segments is indicative of the rolling condition.

12. The method as defined in claim 11, wherein a substantially linear evolution of the difference between the rotational position of the impression cylinder and the rotational position of the plate cylinder as the plate cylinder and the impression cylinder are in rolling contact with one another along their respective cylinder segments is indicative of the desired rolling condition, and wherein a substantially non-linear evolution of the difference between the rotational position of the impression cylinder and the rotational position of the plate cylinder as the plate cylinder and the impression cylinder are in rolling contact with one another along their respective cylinder segments is indicative of an undesired rolling condition.

13. The method as defined in claim 10, wherein the intaglio printing press further comprises a main drive driving the plate cylinder and the impression cylinder into rotation via gears, which gears comprise a first gear coupled to the plate cylinder for rotation with the plate cylinder and a second gear meshing with the first gear and being coupled to the impression cylinder for rotation with the impression cylinder, wherein the desired rolling condition corresponds to a condition where the second gear is allowed to move with respect to the first gear while the plate cylinder and the impression cylinder are in rolling contact with one another along their respective cylinder segments by an amount which does not exceed a gear backlash of the first and second gears.

14. The method as defined in claim 13, wherein the first gear is driven into rotation by the main drive and acts as driving gear, and wherein the desired rolling condition corresponds to a condition where:

(i) the second gear is in contact with a leading face of the first gear upon coming into rolling contact of the plate cylinder and the impression cylinder one with the other, when a trailing end of the cylinder pits leaves the printing nip;

(ii) the second gear is allowed to move away from the leading face of the first gear while the plate cylinder and the impression cylinder are in rolling contact with one another; and (iii) the second gear does not come into contact with a trailing face of the first gear before the rolling contact between the plate cylinder and the impression cylinder is interrupted, when a leading end of the cylinder pits enters the printing nip.

15. The method according to claim 10, further comprising the step of generating a warning in case the rolling condition is indicative of an undesired rolling condition.

* * * * *